US007481507B2

(12) United States Patent
Naruse

(10) Patent No.: US 7,481,507 B2
(45) Date of Patent: Jan. 27, 2009

(54) IMAGE FORMING APPARATUS HAVING IMPROVED OPERABILITY AND MAINTAINABILITY

(75) Inventor: Shinichiroh Naruse, Kanagawa-ken (JP)

(73) Assignee: Ricoh Company, Ltd, Tokyo (JP)

( * ) Notice: Subject to any disclaimer, the term of this patent is extended or adjusted under 35 U.S.C. 154(b) by 330 days.

(21) Appl. No.: 11/378,873

(22) Filed: Mar. 17, 2006

(65) Prior Publication Data

US 2006/0209104 A1 Sep. 21, 2006

(30) Foreign Application Priority Data

Mar. 18, 2005 (JP) ..... 2005-079038

(51) Int. Cl.
*B41J 25/308* (2006.01)

(52) U.S. Cl. ..... 347/8; 347/37

(58) Field of Classification Search ..... 347/8
See application file for complete search history.

(56) References Cited

U.S. PATENT DOCUMENTS 5,678,936 A * 10/1997 Hino ..... 400/55
5,751,301 A * 5/1998 Saikawa et al. ..... 347/8
6,733,102 B2 * 5/2004 Hosono ..... 347/14
6,739,683 B2 * 5/2004 Shimomura et al. ..... 347/8

FOREIGN PATENT DOCUMENTS

| | | |
|---|---|---|
| JP | 9-220841 | 8/1997 |
| JP | 11-78154 | 3/1999 |
| JP | 2002-36660 | 2/2002 |
| JP | 2003-11339 | 1/2003 |
| JP | 2005-111979 | 4/2005 |

* cited by examiner

*Primary Examiner*—Luu Matthew
*Assistant Examiner*—Brian J Goldberg
(74) *Attorney, Agent, or Firm*—Cooper & Dunham, LLP

(57) ABSTRACT

An image forming apparatus includes a removable image forming unit including at least a carriage having an ink jet head, and a recording medium conveyance member, and includes a gap adjustment mechanism including a carriage travel lever unit having first and second levers separably engaged with each other. The second lever includes an operation part for, in gearing with the first lever, causing the carriage to vertically travel so that a gap between the ink jet head and a sheet on the recording medium conveyance member is adjusted.

17 Claims, 13 Drawing Sheets

IMAGE FORMING APPARATUS HAVING IMPROVED OPERABILITY AND MAINTAINABILITY

BACKGROUND

1. Field

This patent specification describes an image forming apparatus, and more particularly an image forming apparatus having an improved operability and maintainability associated with an image forming mechanism.

2. Related Art

A background image forming apparatus such as an ink jet printer includes a mechanism for adjusting a gap between a recording sheet and an ink jet head including a port for discharging ink. The gap adjustment mechanism is provided to a guide rod for supporting a carriage having a head. The gap adjustment mechanism includes a lever having an operation unit partially exposing itself to outside of the image forming apparatus, and when a user operates the lever according to a type of paper, the gap adjustment mechanism causes the guide rod to move up and down. When the guide rod moves up and down, the carriage supported by the guide rod moves up and down so that a gap between a sheet and the head is adjusted.

However, the gap adjustment mechanism is not configured for an image forming apparatus wherein the image forming unit is removable.

SUMMARY

This patent specification describes an image forming apparatus which includes a removable image forming unit and a gap adjustment mechanism. The removable image forming unit includes at least a carriage having an ink jet head, and a recording medium conveyance member. The gap adjustment mechanism is configured to allow the removable image forming unit to be disengaged from the image forming apparatus, while also providing the functionality that allows a gap between a recording sheet and an ink jet head including a port for discharging ink to be adjusted.

The gap adjustment mechanism preferably includes a first portion and a second portion which are joined with and separated from each other with attachment and detachment of the removable image forming unit to and from the image forming apparatus.

In one example, the gap adjustment mechanism includes a carriage travel lever unit having first and second levers separably engaged with each other. The second lever includes an operation part for, in gearing with the first lever, causing the carriage to vertically travel so that a gap between the ink jet head and a sheet on the recording medium conveyance member is adjusted.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
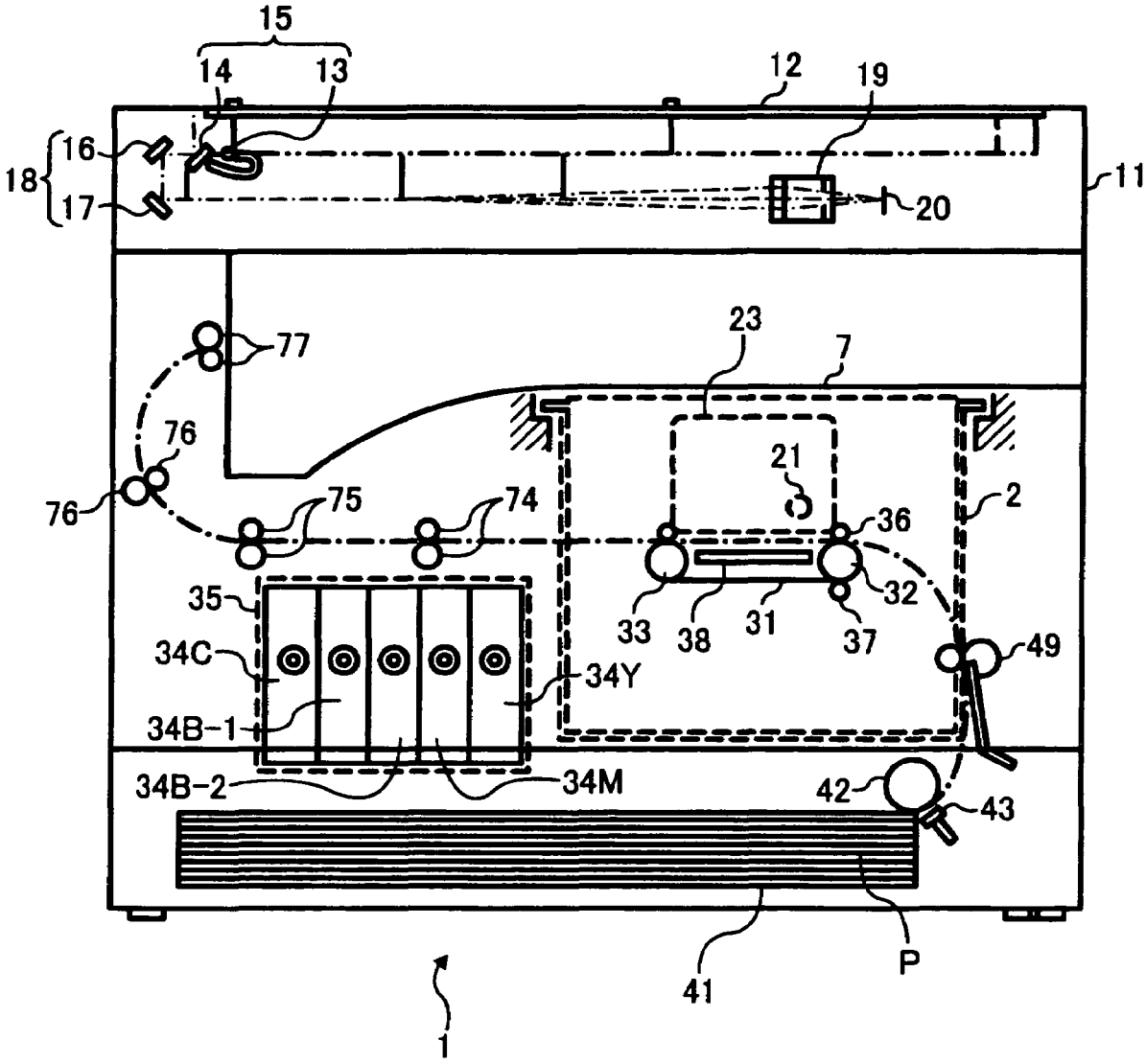
FIG. 1 is a schematic illustration of a configuration of an image forming apparatus according to an embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus according to a preferred embodiment is described.

A general configuration of the image forming apparatus according to the embodiment is described below referring to FIG. 1. As shown in FIG. 1, an image forming apparatus 1 includes an image forming unit 2, an image reading unit 11, a cartridge loading unit 35, and a sheet feeding cassette 41. The image forming apparatus 1 further includes a sheet discharge tray 7, a separation roller 42, a friction pad 43, a pair of sheet feeding rollers 49, and pairs of sheet discharge rollers 74, 75, 76, and 77 including discharge rollers and spurs.

The image forming unit 2 is attachably and detachably mounted to the image forming apparatus 1, and includes a carriage 23 and a guide rod 21 for guiding the carriage 23. The carriage 23 includes heads (not shown) having respective discharge ports for discharging ink in yellow, magenta, cyan, black 1, and black 2 (hereinafter referred to as Y, M, C, B-1, and B-2, respectively) onto a sheet. The image forming unit 2 further includes a conveyance belt 31, a drive roller 32, a driven roller 33, a pressure roller 36, a charge roller 37, and a guide member (platen) 38. The conveyance belt 31 is stretched around the drive roller 32 and the driven roller 33 with adequate tension.

The image reading unit 11 includes an exposure glass 12, a first traveling body 15, a second traveling body 18, a lens 19, and an image reading element 20 such as a CCD. The first traveling body 15 includes a light source 13 for illuminating a document and a mirror 14. The second traveling body 18 includes two mirrors 16 and 17. The image reading unit 11 is arranged at an upper position of the image forming apparatus 1. The first and second traveling bodies 15 and 18 are arranged so as to be able to make a reciprocating motion in a main scanning direction.

The cartridge loading unit 35 accommodates ink cartridges 34C, 34B-1, 34B-2, 34M, and 34Y.

The sheet feeding cassette 41 stores a plurality of sheets P, and can be inserted to and extracted from a front side of the image forming apparatus 1 (a front side in FIG. 1).

In the image reading unit 11, the image reading element 20 is located behind the lens 19. The first and second traveling bodies 15 and 18 scan an image to obtain image data, and send an image signal representing the image data to the image reading element 20. The image reading element 20 receives and digitizes the image signal, and processes the digitized image signal.

The image forming unit 2 forms an image on a sheet P according to the processed image signal. In detail, the drive roller 32, driven by a drive motor (not shown), rotates at a predetermined rotation speed so that the conveyance belt 31 rotates at a predetermined speed. The charge roller 37 having a voltage applied from a high-voltage power supply (not shown) charges the conveyance belt 31. The conveyance belt 31 is guided by the guide member 38 in an area facing the image forming unit 2. The pressure roller 36 presses the sheet P onto the conveyance belt 31 at a position facing the drive roller 32.

Each of the ink cartridges 34C, 34B-1, 34B-2, 34M, and 34Y including ink liquid is connected to a supply pump (not shown). The supply pump is operated as necessary to supply the ink liquid to the carriage 23. The ink cartridges 34C, 34B-1, 34B-2, 34M, and 34Y are attachably and detachably mounted in the cartridge loading unit 35.

The image forming apparatus 1 can receive data of an image from an external equipment via one of a communication cable and a network, and process the data. The image forming unit 2 forms an image from the data. The external equipment for inputting the data to be used by the image forming unit 2 to form the image includes an image processing apparatus such as a computer, an image reading apparatus such as an image scanner, an imaging apparatus such as a digital camera, and so forth.

Figure 2A:
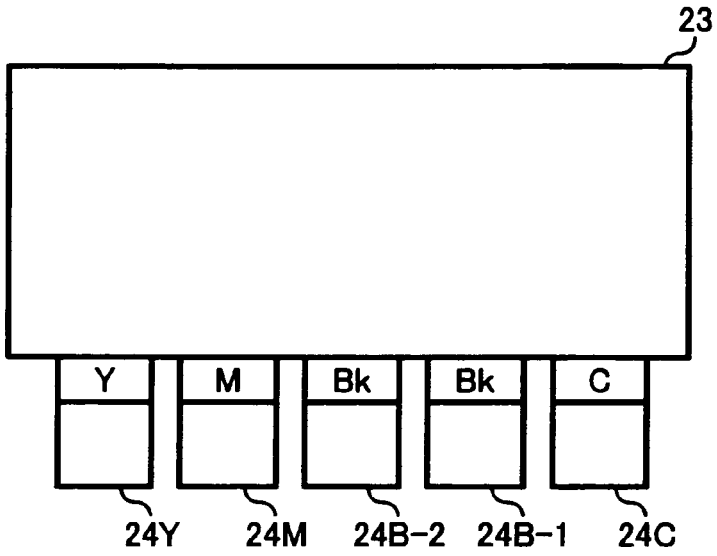
FIG. 2A is a front view of a carriage included in the image forming apparatus of FIG. 1.
Figure 2B:
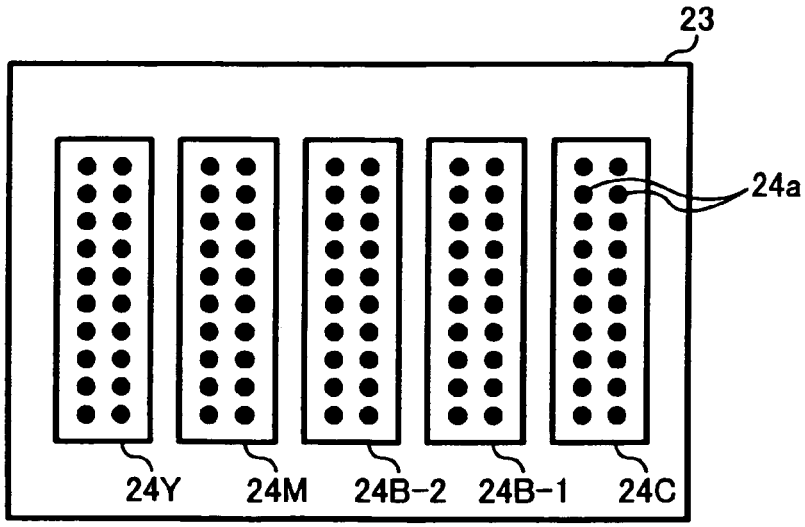
FIG. 2B is a bottom view of the carriage shown in FIG. 2A.

As shown in FIG. 2A and as described above, the carriage 23 includes heads 24C, 24B-1, 24B-2, 24M, and 24Y (hereinafter the suffixes representing the colors are omitted as necessary). As shown in FIG. 2B, each of the heads 24 (hereinafter each of the heads 24 is represented as head 24 as necessary) includes 384 discharge ports 24*a* arranged in two rows×192 columns. The head 24 determines a distance in a sub-scanning direction in which recording can be performed while the sheet P is stopped. The distance represents a height of one line. After recording of one line is finished, the sheet P is conveyed in the main scanning direction so that next one line can be recorded.

Next, an image forming operation of the image forming apparatus 1 is described below referring to FIG. 1.

After an original is set on the exposure glass 12 of the image reading unit 11, when a start button (not shown) is pressed, the first and second traveling bodies 15 and 18 start traveling. The first traveling body 15 emits light from the light source 13. The light is reflected from a surface of the original. While emitting the light, the first traveling body 15 further reflects the reflected light toward the second traveling body 18. The mirrors 16 and 17 of the second traveling body 18 reflect the directed light into the image reading element 20 through the lens 19. An image on the original is read through the above operations so that image data is generated. Alternatively, image data is sent from the external equipment (not shown) via a communication cable and so forth.

The sheet feeding cassette 41 feeds the sheet P to the separation roller 42 and the friction pad 43 so that the sheet P is separated from the rest and is conveyed one after another. The separated sheet P is conveyed by the pair of sheet feeding rollers 49 into the image forming unit 2. In the image forming unit 2, the sheet P is pressed by the pressure roller 36 onto the conveyance belt 31. The sheet P electrostatically adheres to a surface of the conveyance belt 31 having been charged by the charge roller 37, and is conveyed to a position facing the carriage 23. When the sheet P comes to the position, the conveyance belt 31 stops moving. Then, while reciprocating according to the image data the carriage 23 discharges predetermined ink liquid at a predetermined position on the sheet P in a stationary state so that one line of an image is recorded on the sheet P. After the one line is recorded in the main scanning direction, the conveyance belt 31 is driven for a predetermined time to move the sheet P for the one line, and is stopped. Then, as described above, while reciprocating in the main scanning direction, the carriage 23 discharges the ink liquid according to the image data to record a next line of the image. The operation is repeated a predetermined number of times to form the image on the sheet P. Then, the sheet P is conveyed to the discharge tray 7 by the pairs of sheet discharge rollers 74, 75, 76, and 77.

Next, attachment and detachment of the image forming unit 2 to and from the image forming apparatus 1 are described below referring to FIGS. 3 to 6.

Figure 3:
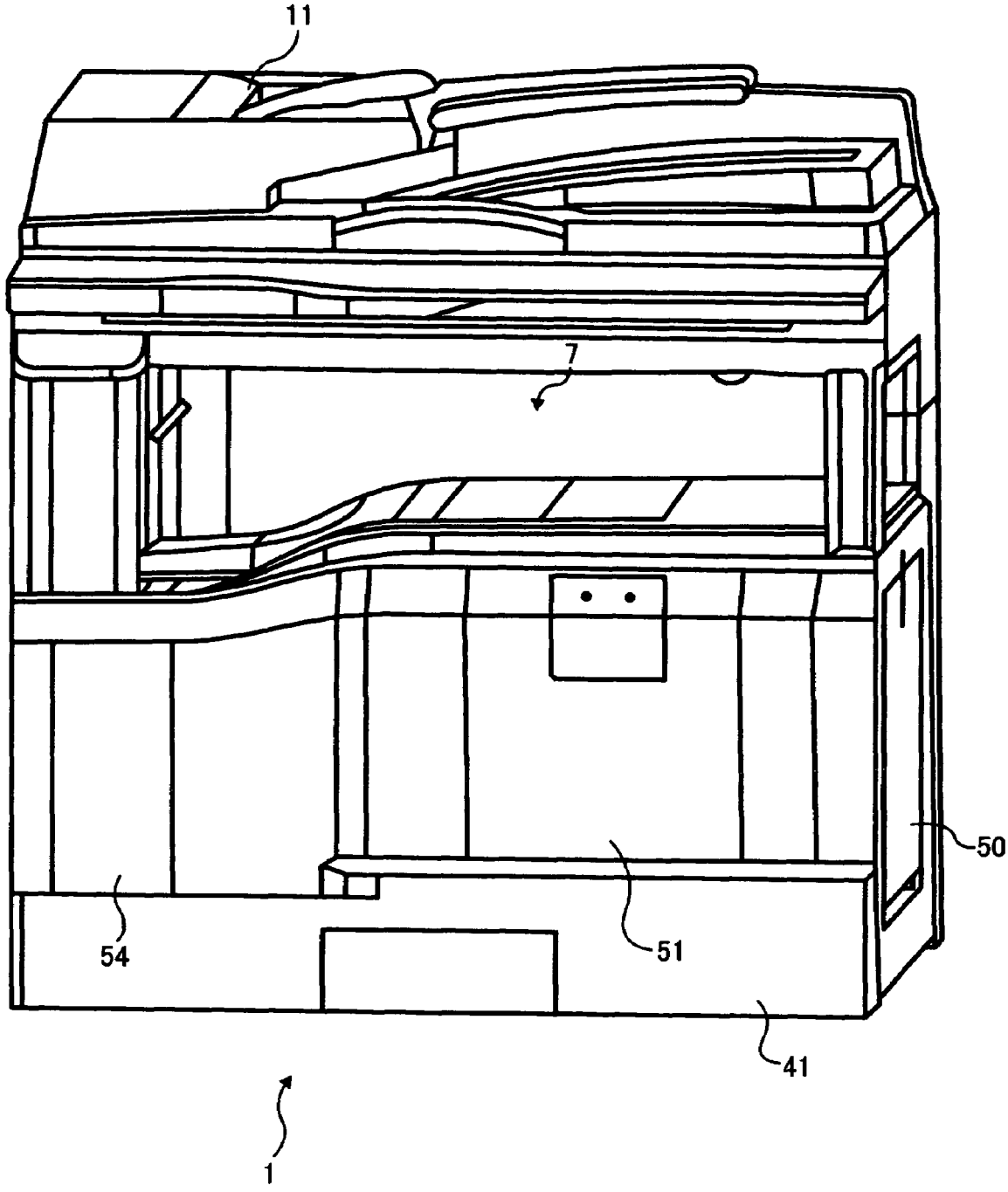
FIG. 3 is a frontal perspective view of the image forming apparatus of FIG. 1.
Figure 4:
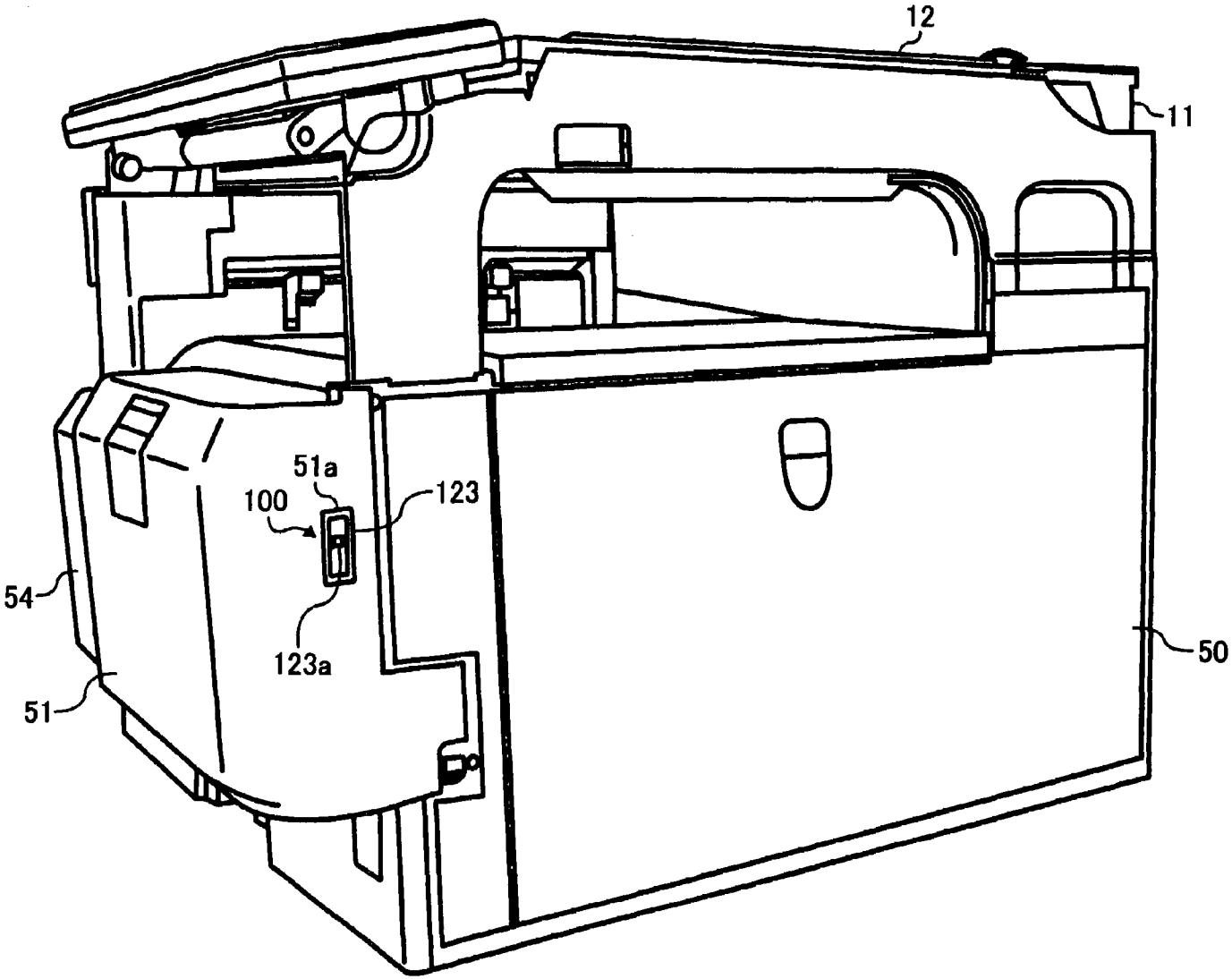
FIG. 4 is another perspective appearance view of the image forming apparatus of FIG. 1.

As shown in FIGS. 3 and 4, a housing of the image forming apparatus 1 includes a first door 50, a second door 51, and a third door 54. The first door 50 is arranged on a side face of the image forming apparatus 1. The second and third doors 51 and 54 are arranged on a front face of the image forming apparatus 1.

When the first, second, and third doors 50, 51, and 54 are opened, the image forming unit 2 can be detached from and attached to the image forming apparatus 1.

Figure 5:
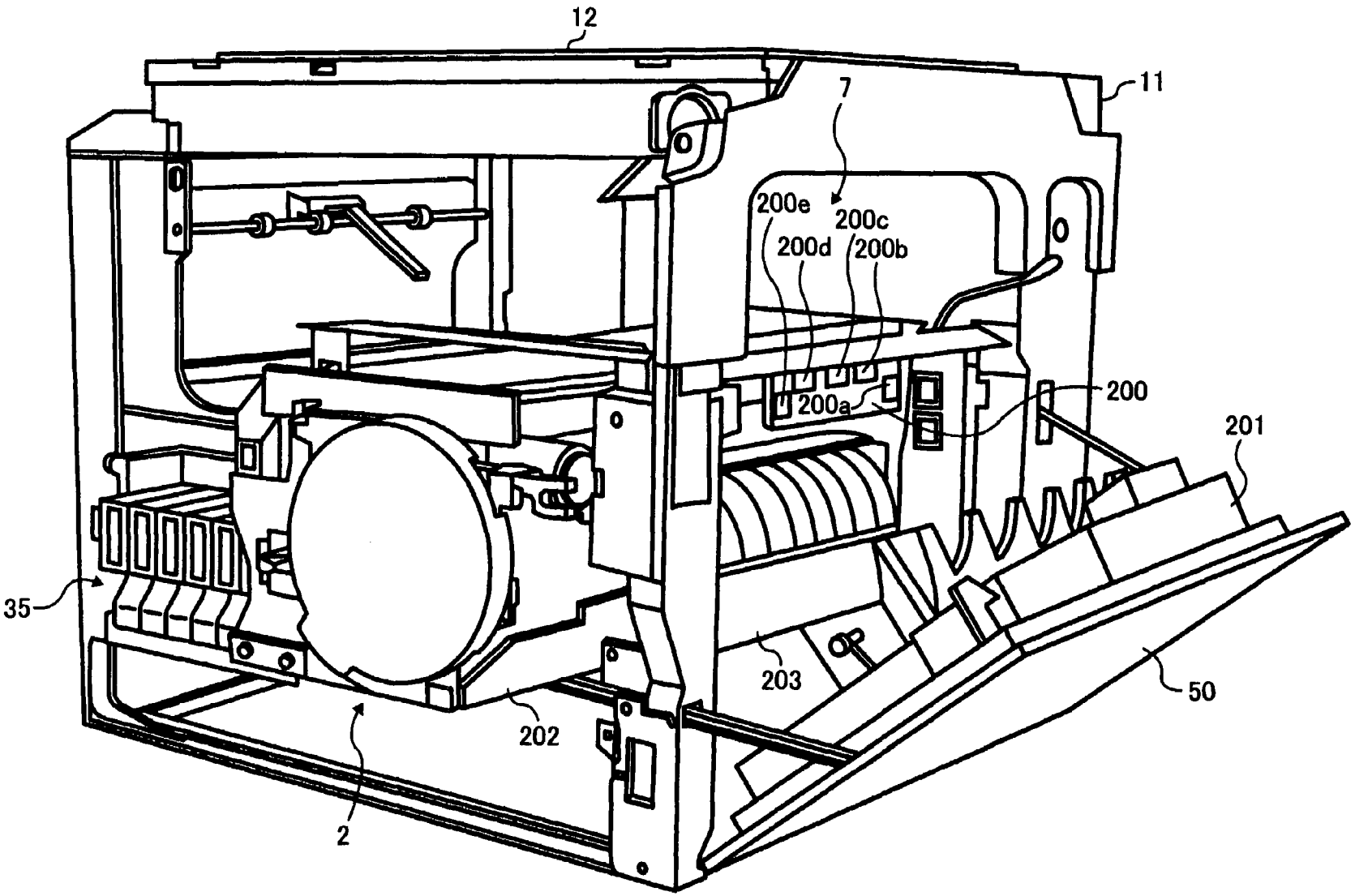
FIG. 5 is a perspective view of the image forming apparatus of FIG. 1 with a first door opened and second and third doors (not shown) opened.

As shown in FIG. 5, the image forming apparatus 1 includes a connector unit 200, a connector unit 201, a lower rail 202, and a rail guide 203. The connector unit 200 includes connectors 200*a*, 200*b*, 200*c*, 200*d*, and 200*e*. The connector unit 200 is arranged on the image forming unit 2, and can be connected with the connector unit 201. The connector unit 201 includes connectors (not shown), and is arranged on the first door 50 of image forming apparatus 1. The lower rail 202 is arranged on the image forming unit 2, and is supported by the rail guide 203.

When the first door 50 is opened, connections of the connectors 200*a* to 200*e* with the corresponding connectors of the connector unit 201 are cut. In other words, opening the first door 50 electrically disconnects the image forming unit 2 from the image forming apparatus 1.

After the connection between the image forming unit 2 and the image forming apparatus 1 is cut by the opening of the first door 50, the second and third doors 51 and 54 (not shown) are opened. Then, the image forming unit 2 is drawn from the image forming apparatus 1 in a frontward direction.

Figure 6:
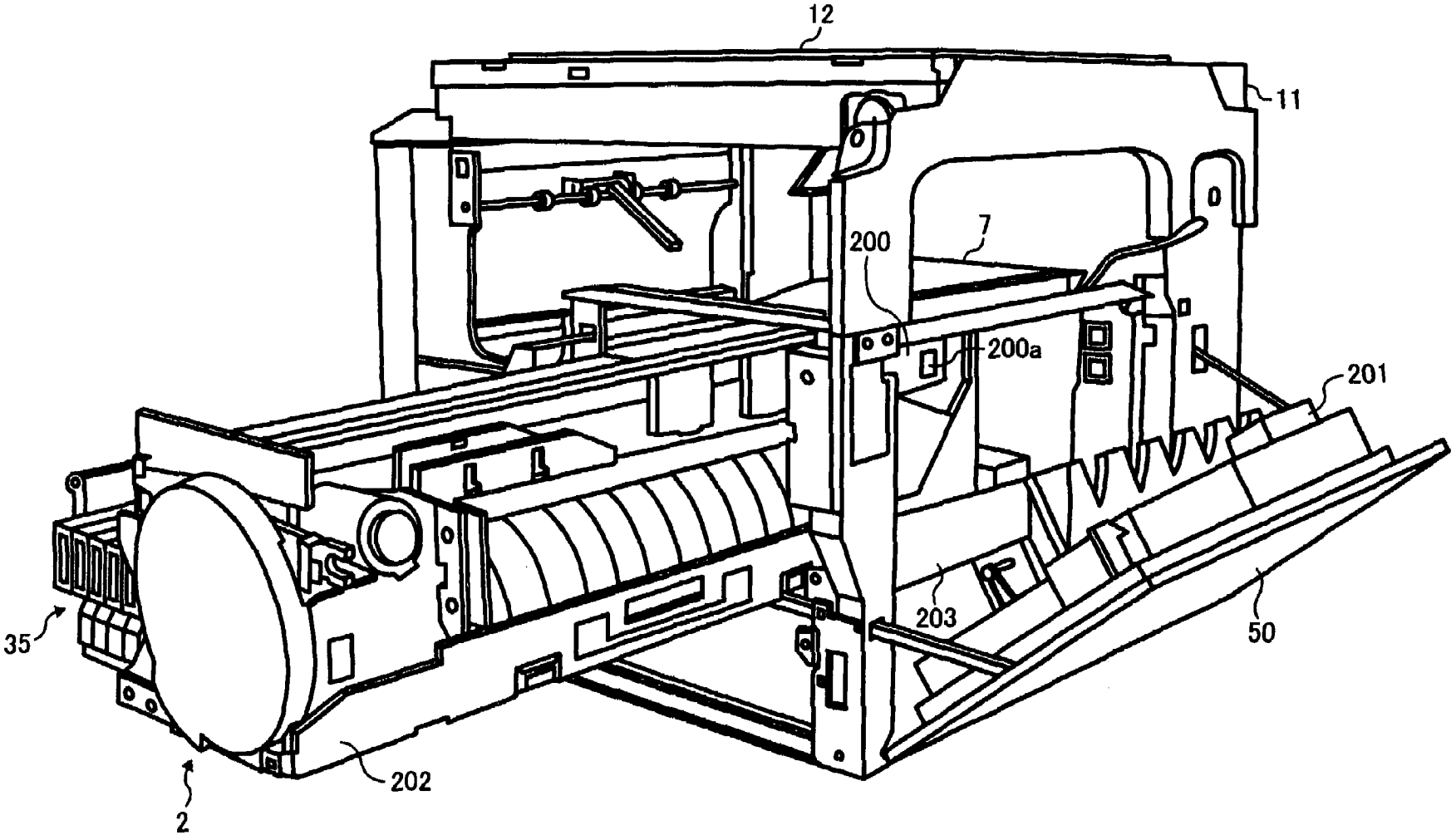
FIG. 6 is a perspective view of the image forming apparatus of FIG. 1 with an image forming unit pulled out.

As a result, the image forming unit 2 is pulled out of the image forming apparatus 1 as shown in FIG. 6. As shown in FIG. 6, the image forming unit 2 and the cartridge loading unit 35 are integrally formed according to the embodiment, and the cartridge loading unit 35 can be attached to and detached from the image forming apparatus 1 together with the image forming unit 2.

When the image forming unit 2 and the cartridge loading unit 35 are separately formed, the connection between an ink supply path (not shown) extending from the cartridge loading unit 35 to the image forming unit 2 and the image forming unit 2 needs to be cut to pull the image forming unit 2 out of the image forming apparatus 1.

In the case, ink may leak out from the ink supply path. In the embodiment, on the other hand, since the image forming unit 2 and the cartridge loading unit 35 are integrally formed, the disconnection between the ink supply path and the image forming unit 2 is not required. As a result, ink does not leak from the ink supply path.

Figure 7:
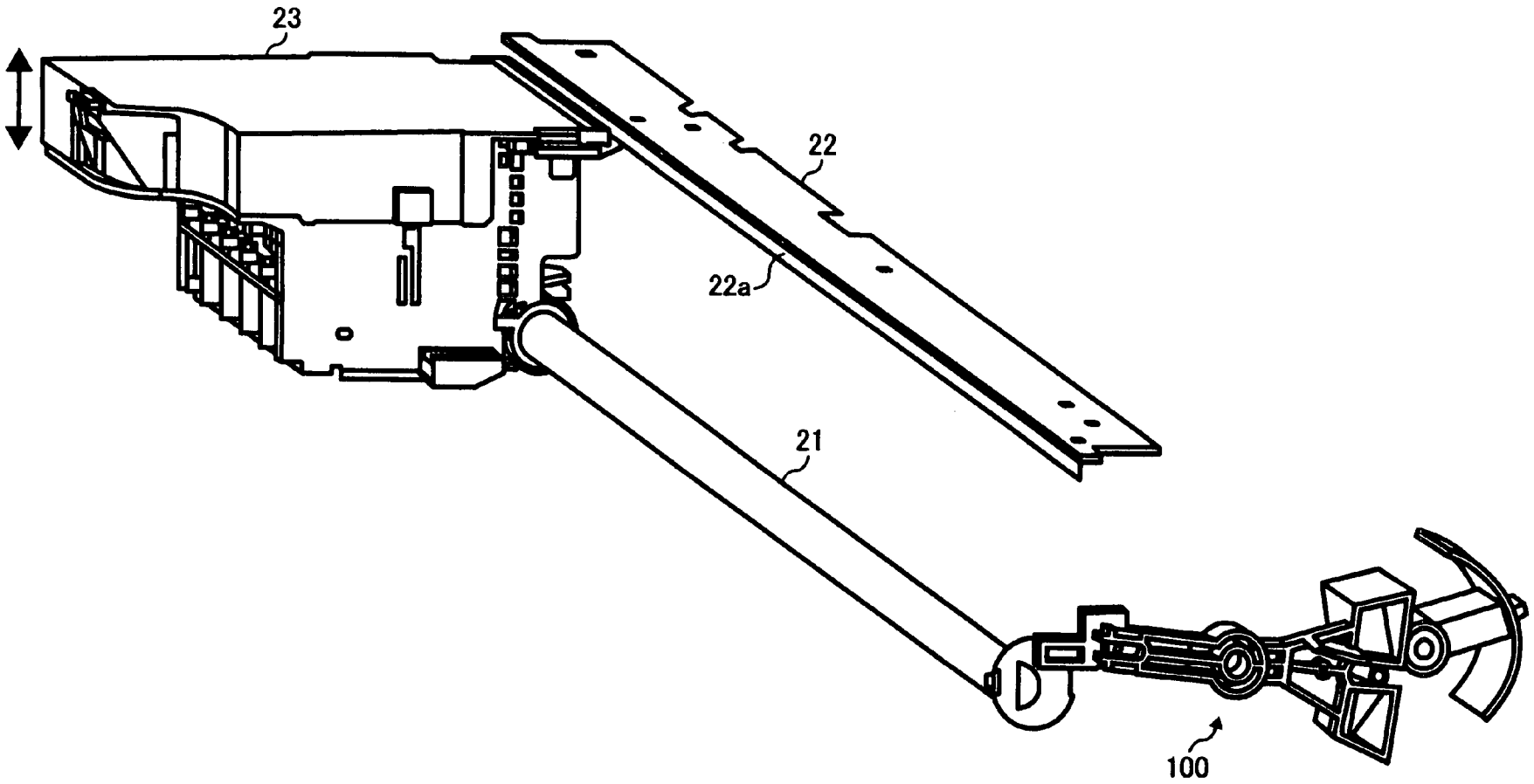
FIG. 7 is an illustration of a carriage support mechanism of a sliding rail according to an embodiment.

FIG. 7 illustrates a supporting mechanism for the carriage 23. As shown in FIG. 7, the carriage 23 is translatably supported by the guide rod 21 and a sliding rail 22 in the main scanning direction. The guide rod 21 is provided with a gap adjustment mechanism 100 which is described later in detail referring to FIGS. 9 and 10. The guide rod 21 penetrates the carriage 23 to support the carriage 23, and is mounted on a side panel (not shown) of the image forming unit 2. The sliding rail 22 includes a hood 22*a* for supporting the sliding rail 22.

Figure 8:
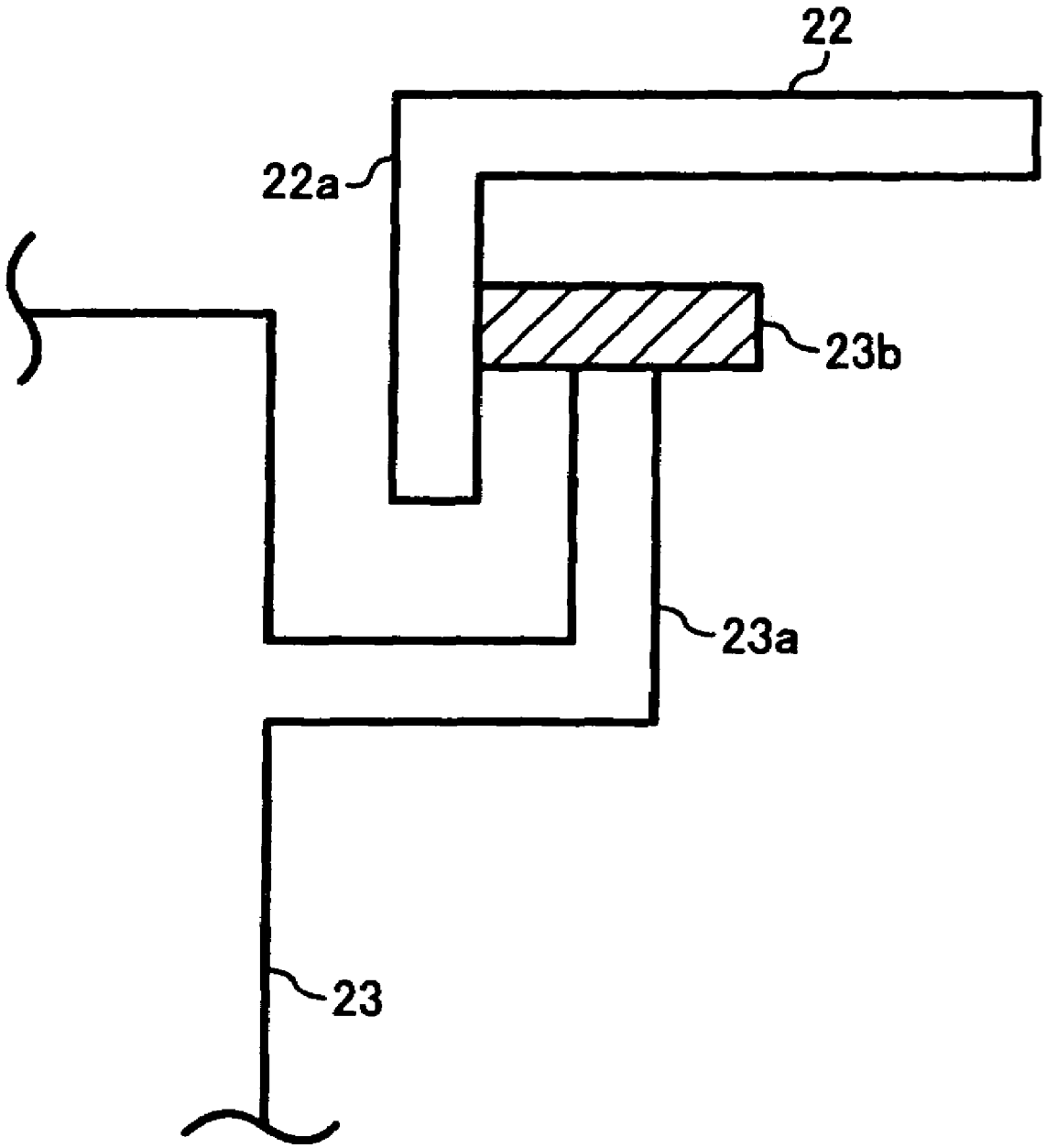
FIG. 8 is a schematic illustration for explaining the carriage support mechanism of FIG. 7.

As shown in FIG. 8, the carriage 23 is provided with an arm 23*a* extending toward the sliding rail 22, and with a sliding member 23*b* arranged on a leading edge of the arm 23*a*. The sliding member 23*b* contacts a side face of a rail of the hood 22*a* to support the carriage 23.

Next, the gap adjustment mechanism 100 is described below in detail referring to drawings. The gap adjustment mechanism 100 is used when printing is performed on a sheet having large thickness such as cardboard to maintain an appropriate gap between the sheet and the head 24. When the gap adjustment mechanism 100 is operated, the guide rod 21 moves up and down. When the guide rod 21 moves up and down, the carriage 23 supported by the guide rod 21 moves up and down together with the guide rod 21. As a result, the gap between the sheet and the head 24 mounted to the carriage 23 is adjusted.

Figure 9:
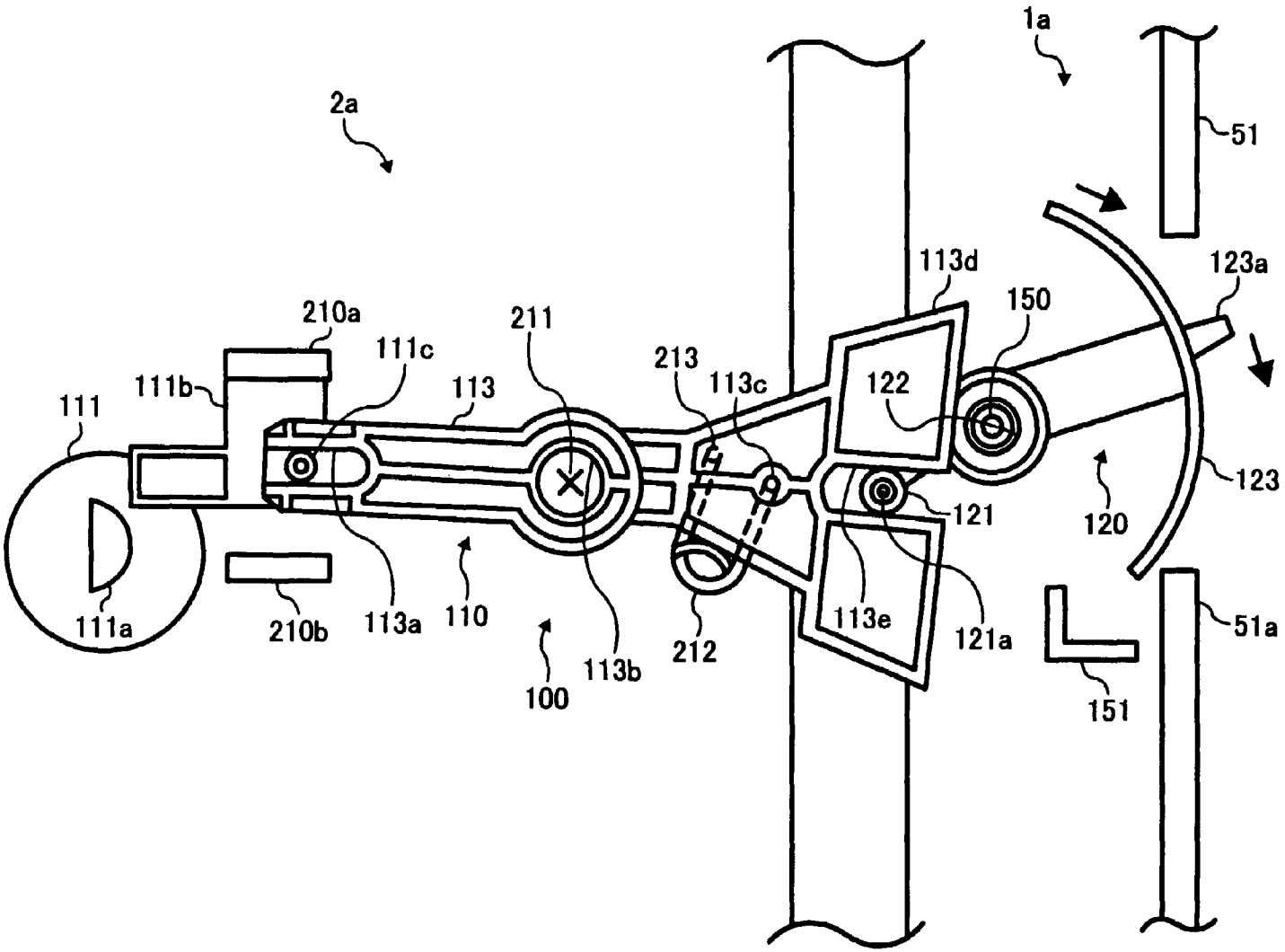
FIG. 9 is an illustration of a gap adjustment mechanism and peripherals thereof in an image forming apparatus according to an example.

As shown in FIG. 9, the gap adjustment mechanism 100 includes a first lever unit 110 and a second lever unit 120. The first lever unit 110 includes an eccentric plate 111 and an arm unit 113. The eccentric plate 111 is provided with a hole 111*a* and a stopper 111*b*. The stopper 111*b* is provided with a convex portion 111*c*.

The arm unit 113 includes a concave portion 113*a* for mounting the arm unit 113, a side plate mount hole 113*b* loosely pierced with a notched screw 211, a spring hold hole 113*c*, a guide member 113*d*, and a joint concave portion 113*e*. The convex portion 111*c* is to be set into the concave portion 113*a* of the arm unit 113.

The second lever unit 120 includes a joint convex portion 121 having a front edge 121*a*, a mount hole 122, and a cover unit 123 serving as an operation unit. The cover unit 123 includes a tab 123*a*.

The image forming unit 2 includes a side plate 2*a*. The first lever unit 110 is rotatably mounted to the side plate 2*a*. The side plate 2*a* includes regulation members 210*a* and 210*b*, and a hold hole 213. The image forming apparatus 1 includes a wall 1*a*. The wall 1*a* includes a pin 150 and a regulation protrusion 151.

The first and second lever units 110 and 120 are configured to be separated from and joined with each other cooperatively with attachment and detachment of the image forming unit 2.

The guide rod 21 is provided with a leading edge. The hole 111*a* of the eccentric plate 111 has a substantially D shape at a position off a center of the eccentric plate 111. The leading edge of the guide rod 21 is trimmed into the same substantially D shape as the hole 111*a*, and is engaged with the hole 11*a*. The regulation members 210*a* and 210*b* on the side face 2*a* of the image forming unit 2 are arranged above and below, respectively, the stopper 111*b* of the eccentric plate 111. The stopper 111*b* abuts on one of the regulation members 210*a* and 210*b* to regulate an amount of rotation of the eccentric plate 111.

With the notched screw 211 screwed into the side plate 2*a* of the image forming unit 2, the first lever unit 110 can be rotatably mounted to the side plate 2*a* of the image forming unit 2. The spring hold hole 113*c* holds an end of a twist spring 212. Another end of the twist spring 212 is held by the hold hole 213 indicated by a dashed line in FIG. 9. The hold hole 213 is arranged at such a position on the side plate 2*a* that a distance between the hold hole 213 and the spring hold hole 113*c* becomes the shortest within a rotatable range of the arm unit 113 when the stopper 111*b* is positioned at a midpoint between the regulation members 210*a* and 210*b*. Therefore, when the stopper 111*b* is positioned at the midpoint, a force applied by the twist spring 212 to the arm unit 113 reaches maximum. The force applied by the twist spring 212 causes the arm unit 113 to rotate in one of clockwise and anti-clockwise directions in FIG. 9 so that the stopper 111*b* abuts on one of the regulation members 210*a* and 210*b*. In other words, the stopper 111*b* is always forced to abut on one of the regulation members 210*a* and 210*b*. As a result, vibration of the image forming apparatus 1 is prevented from causing the gap adjustment mechanism 100 to move so that the gap between the head 24 and the sheet does not shift.

Figure 10:
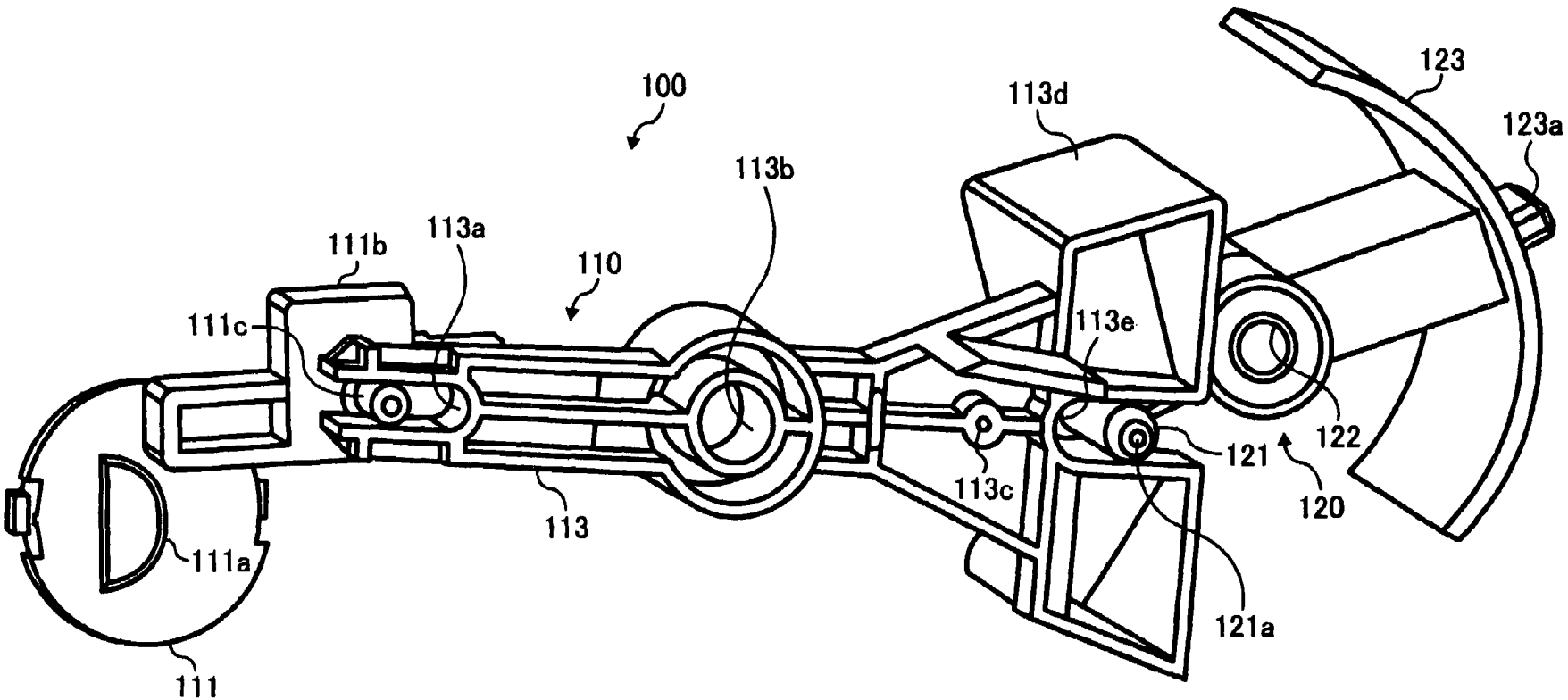
FIG. 10 is a perspective view of the gap adjustment mechanism of FIG. 9.

The guide member 113*d* is arranged at a right end of the arm unit 113 in FIG. 9. The guide member 113*d* includes an inclined plane inclining to a front side toward the joint concave portion 113*e* as shown in FIG. 10. The inclined plane receives the front edge 121*a* of the joint convex portion 121 of the second lever unit 120 so that the front edge 121*a* abuts on the inclined plane to guide the joint convex portion 121 into the joint concave portion 113*e*.

The second lever unit 120 is roratably mounted on the wall 1*a* of the image forming apparatus 1 with the mount hole 122 put on the pin 150 extending from the wall 1*a* by using a ring (not shown). The joint convex portion 121 extends frontward at a left end of the second lever unit 120. When the image forming unit 2 is installed in the image forming apparatus 1, the joint convex portion 121 is joined with the joint concave portion 113*e* of the arm unit 113. A right end of the second lever unit 120 is provided with the cover unit 123 having an arc shape. A part of the cover unit 123 and the tab 123*a* are exposed from a window 51*a* arranged on a side face of the second door 51 as shown in FIG. 4 The wall 1*a* of the image forming apparatus 1 is provided with the regulation protrusion 151 for regulation rotation of the second lever unit 120 due to self weight.

Next, a shift operation of the gap between the head 24 and the sheet is described below referring to FIG. 9. At first, a user pinches the tab 123*a*, and moves the tab 123*a* to a lower side. When the tab 123*a* is moved to the lower side, the second lever unit 120 rotates in the clockwise direction centering on the mount hole 122. When the second lever unit 120 rotates in the clockwise direction, the joint convex portion 121 pushes up the joint concave portion 113*e* of the first lever unit 110 against the force applied by the twist spring 212. Then, the arm unit 113 of the first lever unit 110 rotates in the anti-clockwise direction centering on the side plate mount hole 113*b*, and as a result, the concave portion 113*a* pushes down the convex portion 111*c*. The convex portion 111*c* is pushed down to move the stopper 111*b* downward to part from the regulation member 210*a* arranged above the stopper 111*b*. When the stopper 111*b* moves downward, the eccentric plate 111 rotates in the clockwise direction. The clockwise rotation of the eccentric plate 111 causes the guide rod 21 engaged with the eccentric plate 111 to move upward. As a result, the carriage 23 moves upward.

When the user moves the tab 123*a* further down, and the stopper 111*b* is caused to move to a position lower than the midpoint between the regulation members 210*a* and 210*b*, the force applied by the twist spring 212 changes from a force causing the stopper 111*b* to move upward to a force causing the stopper 111*b* to move downward. The force applied by the twist spring 212 and the force applied by the user to push down the tab 123*a* cause the stopper 111*b* to abut on the regulation member 210*b* arranged below the stopper 111*b*. As a result, the gap between the head 24 and the sheet is shifted from a position for plain paper to a position for cardboard.

Figure 11:
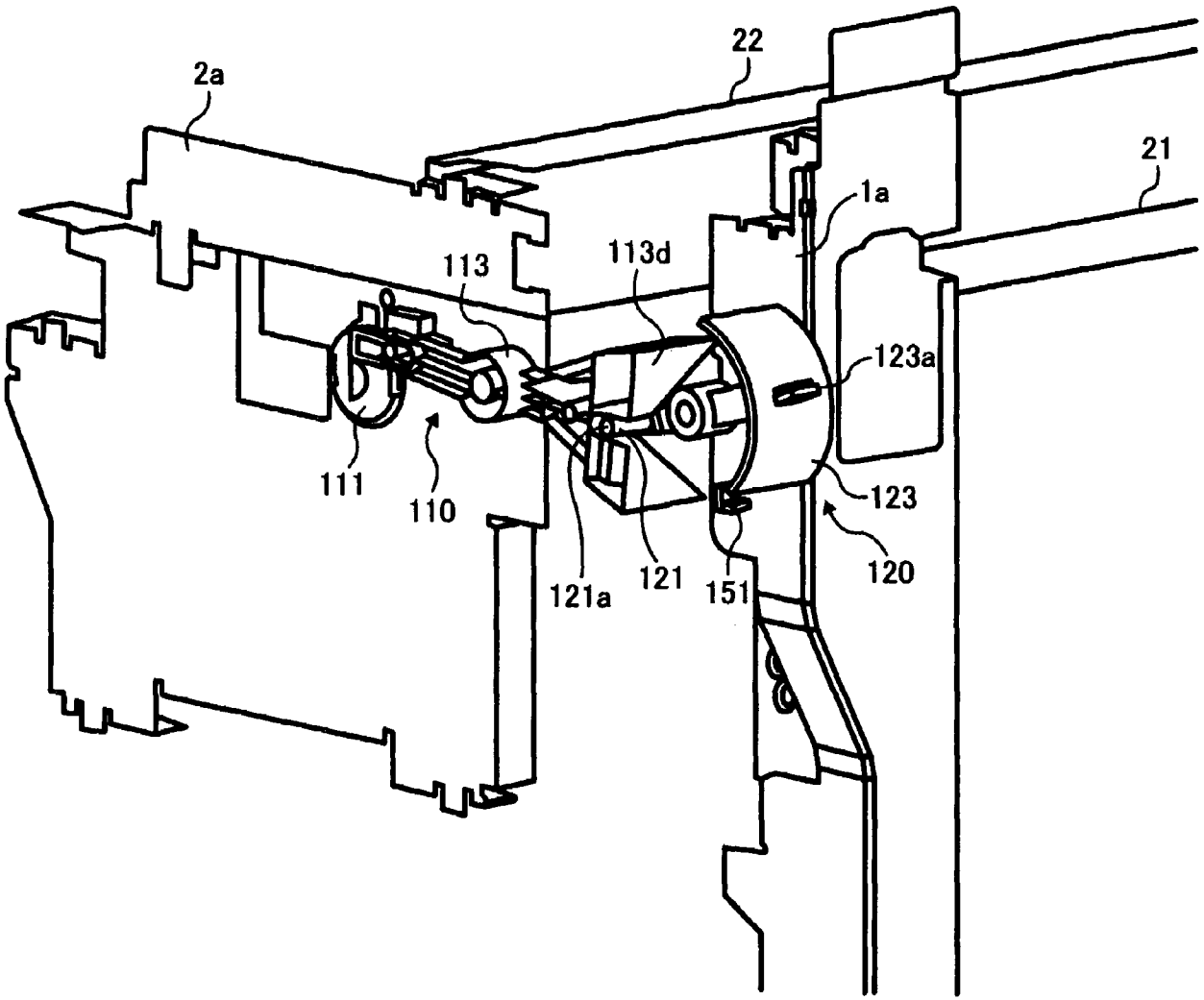
FIG. 11 is a perspective view of a portion of the image forming apparatus of FIG. 1 with first and second lever units joined.
Figure 12:
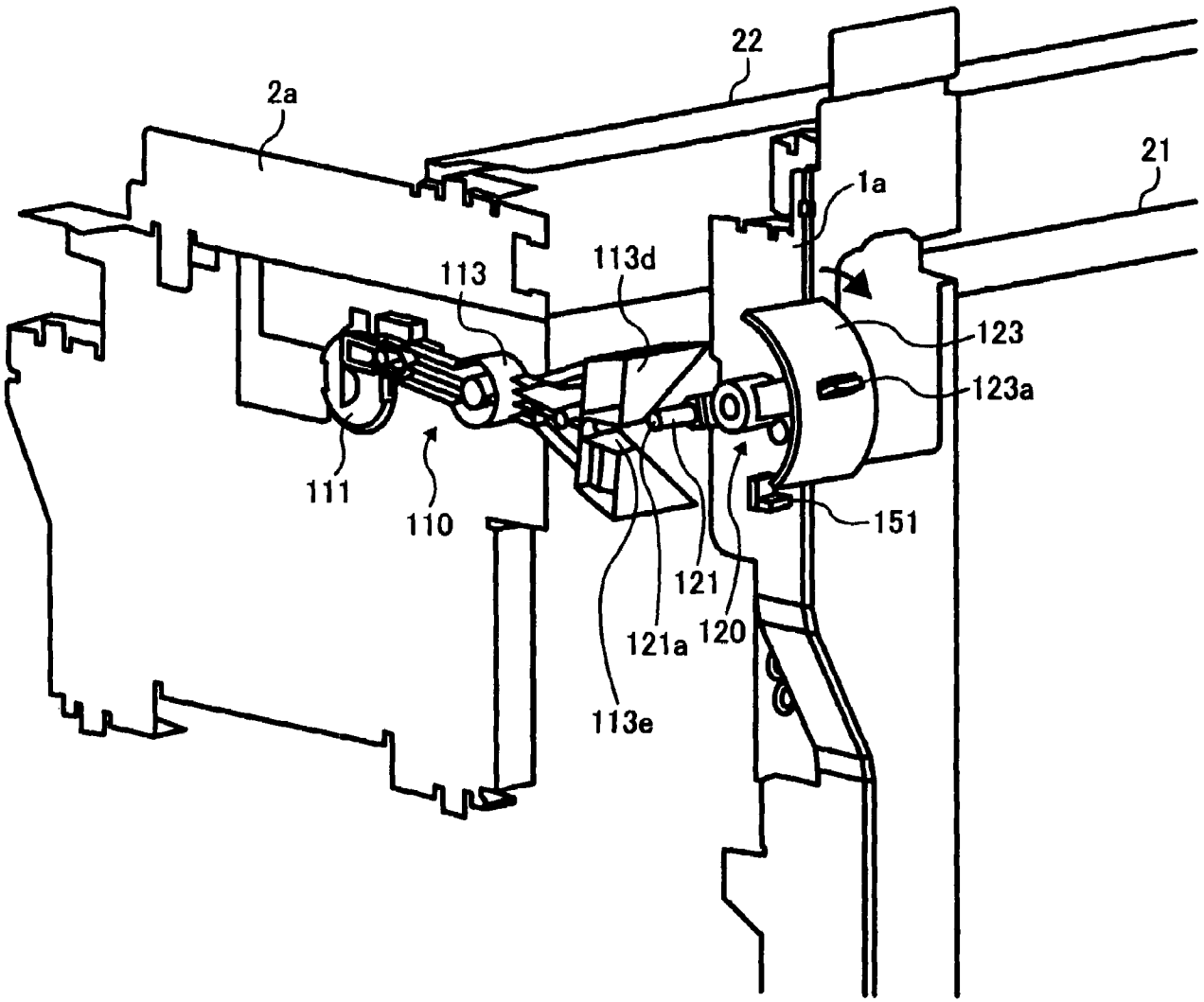
FIG. 12 is a perspective view of a portion of the image forming apparatus of FIG. 1 with the first and second lever units separated.

The first and second lever units 110 and 120 can be joined as shown in FIG. 11, and can be separated as shown in FIG. 12.

As shown in FIG. 11, when the image forming unit 2 is placed inside the image forming apparatus 1, the joint convex portion 121 of the second lever unit 120 is joined with the joint concave portion 113*e* of the first lever unit 110. As shown in FIG. 12, when the image forming unit 2 is slid in a frontward direction and removed from the image forming apparatus 1, the first lever unit 110 and the second lever unit 120 are separated from each other. A right side part of the second lever unit 120 arranged at the right of the mount hole 122, which includes the cover unit 123, is heavier than a left side part of the second lever unit 120 arranged at the left of the mount hole 122, which includes the joint convex portion 121. Therefore, when the second lever unit 120 is released from the joint concave portion 113*e* of the first lever unit 110, the second lever unit 120 rotates in the clockwise direction centering on the mount hole 122. Then, a lower end of the cover unit 123 abuts on the regulation protrusion 151, and the regulation protrusion 151 stops the second lever unit 120 to rotate. Therefore, the regulation protrusion 151 prevents the joint convex portion 121 from not abutting on the inclined plane of the guide member 113*d*.

On the other hand, even when the first lever unit 110 is released from the joining with the second lever unit 120, the force applied by the twist spring 212 keeps the stopper 111*b* to abut on one of the regulation members 210*a* and 210*b*. Therefore, the guide member 113*d* of the first lever unit 110 is regulated so as to abut on the joint convex portion 121.

When the image forming unit 2 is slid into the image forming apparatus 1 (in a backward direction in FIG. 12), the once removed image forming unit 2 is again placed inside the image forming apparatus 1. When the image forming unit 2 is slid, the front edge 121*a* of the joint convex portion 121 of the second lever unit 120 abuts on the inclined plane of the guide member 113*d* of the first lever unit 110. When the image forming unit 2 is further slid into the image forming apparatus 1 with the front edge 121*a* of the joint convex portion 121 abutting on the inclined plane of the guide member 113*d*, the joint convex portion 121 is guided by the inclined plane to move to a lower side. As the front edge 121*a* of the joint convex portion 121 has a spherical shape so that the front edge 121*a* has small frictional drag on the inclined plane, the front edge 121*a* smoothly moves on the inclined plane. When the image forming unit 2 is further slid into the image forming apparatus 1 to mount the image forming unit 2 on the image forming apparatus 1, the joint convex portion 121 is guided by the inclined plane to join with the joint concave portion 113*e* of the first lever unit 110. As a result, the first lever unit 110 and the second lever unit 120 are joined with each other.

Figure 13:
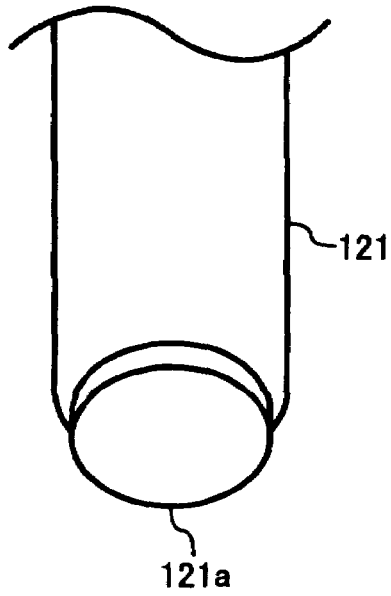
FIG. 13 is a schematic illustration of an exemplary front edge of the second lever unit which includes a rollable ball member.
Figure 14:
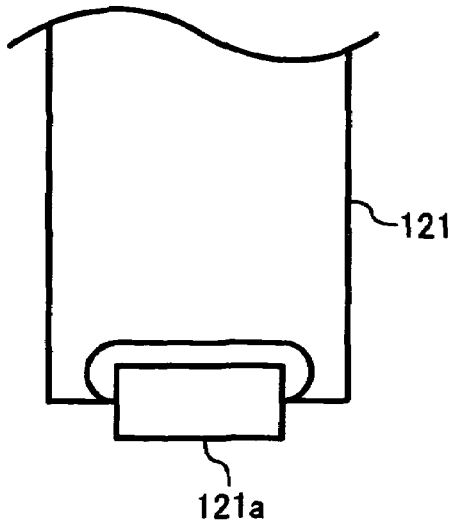
FIG. 14 is a schematic illustration of another exemplary front edge of the second lever unit which includes a rotatable cylindrical member.

While the front edge 121*a* of the joint convex portion 121 has a spherical shape in the embodiment, the front edge, in another example, may include a ball member so that the joint convex portion includes a rollable ball. In the case, a concave member is provided at a front end of the joint convex portion so as to receive the ball member. When the front edge abuts on the inclined plane to move toward the joint concave portion, the ball member rolls. As a result, the frictional drag between the inclined plane and the front edge is reduced, and the joint convex portion can smoothly move on the inclined plane. The shape of the member included in the front edge is not limited to the ball shape as shown in FIG. 13. The front edge may include a cylindrical member so that the joint convex portion includes a rotatable cylinder as shown in FIG. 14 instead. Similar to the front edge shown in FIG. 13, when the front edge shown in FIG. 14 abuts on the inclined plane to move, the cylindrical member rotates, and the frictional drag between the inclined plane and the front edge can be reduced.

While the user pinches the tab 123*a* to move the tab up and down so that the gap between the head 24 and the sheet can be manually adjusted, the gap may be adjusted in another way. For example, the gap may be automatically adjusted by driving the second lever unit by a motor. In such a case, the user sets a type of paper in an operation section, and the motor can be driven based on, for example, set information to rotate the second lever unit so that the gap between the head and the sheet is adjusted. In another example, a thickness detection sensor for detecting a thickness of the sheet may be provided in a sheet conveyance route, and the gap may be adjusted by driving the motor based on output information of the thickness detection sensor to rotate the second lever unit. The thickness detection sensor may be a transmit photodetector. The transmit photodetector detects a thickness of the sheet from an amount of light transmitted the sheet. As the sheet becomes thicker, the amount of light transmitted the sheet becomes smaller. Therefore, when the amount of light is smaller than a predetermined value, it is judged that the sheet is cardboard, and the motor is driven to rotate the second lever unit so that the gap between the head and the sheet is shifted to the position for cardboard.

While in the examples and embodiments described supra the first and second lever units 110 and 120 include the joint concave portion 113*e* and convex portion 121, respectively, and the first and second lever units 110 and 120 are separated from and joined wit each other cooperatively with attachment and detachment of the image forming unit 2, in another example, the first lever unit can include a joint convex portion and the second lever unit can includes a joint concave portion instead. In the case, a guide member for guiding the joint convex portion of the first lever unit to the joint concave portion of the second lever unit can be provided at a left end of the second lever unit. In such an example, when the image forming unit is attached to the image forming apparatus, the joint convex portion of the first lever unit abuts on an inclined plane provided to the guide member of the second lever unit. Further, when the image forming unit is slid in an attaching direction, the joint convex portion of the first lever unit pushes the inclined plane. As a result, the second lever unit rotates, and the joint convex portion of the first lever unit relatively moves on the inclined plane to join with the joint concave portion of the second lever unit.

Further, while in the examples and embodiments described supra the regulation members 210*a* and 210*b* for regulating the rotation of the first lever unit 110 are arranged on the side face 2*a* of the image forming unit 2, the regulation members may be arranged on an outer casing covering the side face of the image forming unit.

The above-described specific examples and embodiments are illustrative, and many variations can be introduced on these examples and embodiments without departing from the spirit of the disclosure or from the scope of the appended claims. For example, elements and/or features of different examples and illustrative embodiments may be combined with each other and/or substituted for each other within the scope of this disclosure and appended claims.

This patent specification is based on a Japanese patent application, No. JP2005-079038 filed on Mar. 18, 2005 in the Japan Patent Office, the entire contents of which are incorporated by reference herein.

What is claimed is:

1. An image forming apparatus, comprising:

an image forming apparatus body;

a removable image forming unit removable from the image forming apparatus body, the image forming unit including at least a carriage having an ink jet head, and a recording medium conveyance member; and a gap adjustment mechanism including a carriage travel lever unit having an operation part for causing the carriage to vertically travel so that a gap between the ink jet head and a sheet on the recording medium conveyance member is adjusted;

a first lever provided on the removable image forming unit; and a second lever provided on the image forming apparatus body and configured to be separated from the removable image forming unit when the removable image forming unit is detached from the image forming apparatus body and to be joined with the removable image forming unit when the removable image forming unit is attached with the image forming apparatus body.

2. The image forming apparatus according to claim 1, wherein at least one of the first lever and the second lever is rotatably mounted on a corresponding one of the removable image forming unit and the image forming apparatus body.

3. The image forming apparatus according to claim 1, further comprising:

an operation section configured to input set information provided by a user; and a drive motor configured to operate the carriage travel lever unit to adjust gap between the ink jet head and the sheet according to the set information.

4. The image forming apparatus according to claim 1, wherein said image forming body includes a window, and said operation part is coupled to at least one of said first and second levers and protrudes through said window for user operation to cause the carriage to vertically travel so that a gap between the ink jet head and a sheet on the recording medium conveyance member is adjusted.

5. The image forming apparatus according to claim 1, wherein the removable image forming unit further includes a guide rod configured to guide the carriage in a main scanning direction.

6. The image forming apparatus according to claim 5, wherein the first lever comprises:

an eccentric plate having a hole in which the guide rod is engaged, and wherein, when the first lever is rotated, the guide rod is moved via rotation of the eccentric plate to adjust the gap between the ink jet head and the sheet.

7. The image forming apparatus according to claim 1, wherein a first direction in which the removable image forming unit is attached to or detached from the image forming apparatus body is substantially parallel with a second direction in which the first lever is joined with or separated from the second lever.

8. The image forming apparatus according to claim 7, wherein the first direction and the second direction are substantially made parallel with respect to at least one of a top surface and a bottom surface of the image forming apparatus body.

9. The image forming apparatus according to claim 1, wherein at least one of the first lever and second lever comprises:

a regulation part configured to regulate rotation of the corresponding lever when the first lever and the second lever are separated from each other.

10. The image forming apparatus according to claim 9 wherein the first lever comprises:

an arm unit configured to rotate in one of predetermined directions, wherein the regulation part is provided on a surface of the removable image forming unit above and below the arm unit to restrict the movement of the first lever when the first lever is separated from the second lever.

11. The image forming apparatus according to claim 9, wherein the second lever comprises:

a first side part; and a second side part having a weight less than a weight of the first side part to cause the second lever to rotate in a predetermined direction when the second lever is separated from the first lever, wherein the regulation part is provided on a side of the image forming apparatus body below the second lever unit to regulate the rotation of the second lever when the second lever is separated from the first lever.

12. The image forming apparatus according to claim 1, wherein one of the first and second levers includes a joint concave portion while the other one of the first and second levers includes a joint convex portion, and the joint convex portion is engaged with the joint concave portion when the removable image forming unit is attached with the image forming apparatus body.

13. The image forming apparatus according to claim 12, wherein a first direction in which the removable image forming unit is attached to or detached from the image forming apparatus body is substantially parallel with a second direction in which the joint convex portion is joined with or separated from the joint concave portion.

14. The image forming apparatus according to claim 13, wherein the first direction and the second direction are substantially made parallel with respect to at least one of a top surface and a bottom surface of the image forming apparatus body.

15. The image forming apparatus according to claim 12, wherein the one of the first and second levers including the joint concave portion further includes a guide member configured to abut on the joint convex portion when the removable image forming unit is caused to be attached with the image forming apparatus body to guide the joint convex portion into the joint concave portion.

16. The image forming apparatus according to claim 15, wherein the joint convex portion comprises:

a spherical shape member configured to abut on the guide member while rolling relative to the joint convex portion when the removable image forming unit is caused to be attached with the image forming apparatus body.

17. The image forming apparatus according to claim 15, wherein the joint convex portion comprises:

a cylindrical shape member configured to abut on the guide member while rotating relative to the joint convex portion when the removable image forming unit is caused to be attached with the image forming apparatus body.

* * * * *